US009979132B1

(12) United States Patent
Flaherty, IV

(10) Patent No.: US 9,979,132 B1
(45) Date of Patent: May 22, 2018

(54) COAXIAL CONNECTORS WITH GROUNDING TUBE FOR ALTERING A GROUND PATH WITH A CONDUCTOR

(71) Applicant: Corning Optical Communications RF LLC, Glendale, AZ (US)

(72) Inventor: Thomas Edmond Flaherty, IV, Surprize, AZ (US)

(73) Assignee: Corning Optical Communications RF LLC, Glendale, AZ (US)

( * ) Notice: Subject to any disclaimer, the term of this patent is extended or adjusted under 35 U.S.C. 154(b) by 0 days. days.

(21) Appl. No.: 15/581,615

(22) Filed: Apr. 28, 2017

(51) Int. Cl.
*H01R 13/648* (2006.01)
*H01R 9/05* (2006.01)
*H01R 24/40* (2011.01)
*H01R 103/00* (2006.01)

(52) U.S. Cl.
CPC ..... *H01R 13/6485* (2013.01); *H01R 9/0503* (2013.01); *H01R 9/0512* (2013.01); *H01R 24/40* (2013.01); *H01R 2103/00* (2013.01)

(58) Field of Classification Search
CPC .. H01R 2103/00; H01R 24/40; H01R 9/0512; H01R 9/0503; H01R 13/6485
USPC ..... 439/92, 188, 944; 200/51.1
See application file for complete search history.

(56) References Cited

U.S. PATENT DOCUMENTS 5,577,924 A * 11/1996 Louwagie ..... H01R 13/7032 333/124
6,106,314 A * 8/2000 McLean ..... H01R 13/7032 200/51.1
7,338,329 B2 * 3/2008 Yang ..... H01R 24/58 439/188
7,347,727 B2 3/2008 Wlos et al.
7,371,124 B2 * 5/2008 Khemakhem ..... H01P 1/045 439/668
7,416,444 B1 * 8/2008 Lin ..... H01R 13/2421 200/51.1
7,458,834 B1 * 12/2008 Chen ..... H01R 13/11 439/188
7,632,122 B2 * 12/2009 Pesant ..... H01R 24/44 439/188
8,002,574 B1 8/2011 Yi
8,043,118 B1 10/2011 Lee
8,142,214 B1 * 3/2012 Huang ..... H01R 9/0521 439/188
(Continued)

*Primary Examiner* — Abdullah Riyami
*Assistant Examiner* — Nelson R Burgos-Guntin
(74) *Attorney, Agent, or Firm* — Tamika A. Crawl-Bey

(57) ABSTRACT

Coaxial connectors with a grounding tube for altering a ground path with a conductor of the coaxial connector are disclosed. The coaxial connector comprises a grounding tube mounted within the connector housing and around at least a portion of a first conductor to initially establish and subsequently disconnect a grounding path between the first conductor and a housing of the coaxial connector. After contacting the mating connector, the first conductor moves, along with a first conductor housing, which moves a plurality of fingers of the grounding tube from the closed position to the open position. This disconnects the grounding path between the first conductor and the connector housing and establishes an electrical path between the first conductor and the mating connector. Thus, the coaxial connector is grounded before establishing an electrical connection between the coaxial connector and a mating connector.

21 Claims, 10 Drawing Sheets

(56) References Cited

U.S. PATENT DOCUMENTS

| | | | | |
|---|---|---|---|---|
| 8,172,617 | B2 * | 5/2012 | Peng | H01R 24/44 439/188 |
| 8,303,323 | B2 * | 11/2012 | Peng | H01R 13/7033 439/188 |
| 8,636,522 | B2 * | 1/2014 | Sykes | H01R 9/0515 439/63 |
| 9,048,600 | B2 | 6/2015 | Holland | |
| 9,537,232 | B2 | 1/2017 | Hanson et al. | |
| 9,716,345 | B2 * | 7/2017 | Watkins | H01R 13/6581 |
| 2010/0221940 | A1 * | 9/2010 | Hoyack | H01R 24/44 439/188 |
| 2011/0312199 | A1 * | 12/2011 | Alrutz | H01R 13/622 439/188 |
| 2013/0115809 | A1 * | 5/2013 | Hanson | H01R 13/2421 439/578 |
| 2017/0201047 | A1 * | 7/2017 | Hanson | H01R 13/6591 |

* cited by examiner

COAXIAL CONNECTORS WITH GROUNDING TUBE FOR ALTERING A GROUND PATH WITH A CONDUCTOR

BACKGROUND

The disclosure relates generally to electrical coaxial connectors for establishing electrical connections between mated electrical connectors, and more particularly to electrical coaxial connectors with a grounding tube for initially establishing and subsequently disconnecting a ground path with a conductor of the coaxial connector.

Coaxial connectors are frequently used to establish electrical connections between different electronic devices and/or electronic components to each other to establish electronic communication between them. A coaxial connector is an electrical connector typically used with coaxial cables to maintain a quality connection and shielding across the connection of coaxial components. In particular, coaxial connectors are configured to carry (e.g., propagate) electrical signals (e.g., frequency signals, radio frequency (RF) signals, microwave RF signals, etc.) across the connection of coaxial components. Some coaxial connectors are used as adapters to mate to and provide electrical communication between two other connectors that need to be mated.

Coaxial connectors conventionally include electrically conductive contacts, which are surrounded by a non-conductive insulator, such as plastic, which is then surrounded by a housing, among other components. In manufacturing and machining a coaxial connector, each of the components (e.g., parts, pieces) of the coaxial connector has a certain manufacturing tolerance or range of variability (e.g., +/−0.001 mm). When the coaxial connector is assembled, the manufacturing tolerances of each individual component attribute to a tolerance stack up or range of variability of the entire assembly. In other words, for example, the precise location of the tip of a conductor (e.g., male pin contact, female socket contact, etc.) relative to an end of the housing may vary between different coaxial connectors, even though the coaxial connectors are of the same type and manufacture. This creates some variability in the compression and/or mating distance required for these connectors to make and/or maintain electrical contact for continuous signal conductivity.

Further, these coaxial connectors conventionally require a grounding contact as part of the circuit connection made by the connector. However, electrical surges may occur as the coaxial connector is mated to another connector where an electro-static discharge (ESD) is generated across the conductors prior to grounding through the grounding contact due to a buildup of static charge in the connectors. Such an electrical surge may cause damage to electronic equipment (e.g., printed circuit board (PCB) and/or components thereof) in electrical communication with the coaxial connector. Further, without a proper ground connection, the coaxial connector may not function properly (e.g., may not provide a properly functioning RF path) and/or may experience rapid electrical degradation of the conductors of the corresponding connectors.

No admission is made that any reference cited herein constitutes prior art. Applicant expressly reserves the right to challenge the accuracy and pertinency of any cited documents.

SUMMARY

Embodiments of the disclosure are directed to coaxial connectors with a grounding tube for altering a ground path with a conductor of the coaxial connector. The coaxial connector is configured to establish a ground path before an electrical path between and through two mating connectors. In exemplary aspects disclosed herein, the coaxial connector comprises a connector housing with a first conductor mounted within the connector housing by a first conductor housing and a second conductor mounted within the connector housing by a second conductor housing. Further, the coaxial connector comprises a grounding tube mounted within the connector housing and around at least a portion of the first conductor to initially establish and subsequently disconnect a grounding path between the first conductor and the housing. In certain embodiments, the grounding tube comprises a plurality of fingers inwardly radially biased and movable between a closed position and an open position to make and break electrical contact with the first conductor. The initial grounding path shorts any potential electro-static discharge (ESD) that may result between the first conductor of the coaxial connector and the mating connector during mating therebetween. After the first conductor of the coaxial connector contacts the mating connector, the first conductor moves (e.g., axially translates), along with the first conductor housing, which moves the plurality of fingers from the closed position to the open position. As an example, this disconnects the grounding path between the first conductor and the connector housing and connects the first connector to the mating connector to establish an electrical path between the first conductor and the mating connector and through the coaxial connector. Thus, the coaxial connector can be grounded before establishing an electrical connection between and through the coaxial connector and a mating connector.

One embodiment of the disclosure relates to a coaxial connector. The coaxial connector comprises a connector housing, a first conductor mounted within the connector housing and is configured to electrically contact a first connector, and a grounding tube mounted within and in electrical communication with the connector housing. The grounding tube is positioned around at least a portion of the first conductor. The grounding tube comprises a plurality of fingers inwardly radially biased and movable between a closed position and an open position. The plurality of fingers are configured to electrically engage with the first conductor in the closed position to establish a grounding path between the first conductor and the connector housing. The coaxial connector is configured to establish an electrical path between the first conductor and the first connector after the plurality of fingers of the grounding tube outwardly radially pivot to the open position to electrically disengage the first conductor and disconnects the grounding path between the first conductor and the connector housing.

An additional embodiment of the disclosure relates to a coaxial connector comprising a connector housing, a first conductor, a second conductor, a grounding tube, and a grounding collar. The connector housing comprises a connector housing first end and a connector housing second end. The first conductor comprises a first conductor first end and a first conductor second end. The first conductor first end is configured to contact a first connector. The first conductor is mounted within the connector housing towards the connector housing first end by a first dielectric. The first conductor is biased towards the connector housing first end and is configured to move towards the connector housing second end upon contact of the first conductor first end with the first connector. The second conductor comprises a second conductor first end and a second conductor second end. The second conductor first end is in electrical contact with the first conductor second end. The second conductor second end is configured to contact a second connector. The second conductor is mounted within the connector housing towards the connector housing second end by a second dielectric. The second conductor is fixed relative to the connector housing. The grounding tube is mounted within and in electrical communication with the connector housing. The grounding tube is positioned around at least a portion of the first conductor. The grounding tube comprises a plurality of fingers inwardly radially biased and movable between a closed position and an open position. The plurality of fingers electrically are configured to electrically engage with the first conductor in the closed position to establish a grounding path between the first conductor and the connector housing. The grounding collar is mounted to and in electrical communication with the connector housing with at least a portion of the first conductor positioned within the grounding collar. The grounding collar is biased towards the connector housing first end and is configured to move towards the connector housing second end upon contact with the first connector. The coaxial connector is configured to establish an electrical path between the second conductor, the first conductor, and the first connector: (i) after establishing a grounding path between the first conductor, the grounding tube, the connector housing, the grounding collar, and the first connector, (ii) after movement of the grounding collar relative to the connector housing, (iii) after movement of the first conductor relative to the connector housing and the grounding tube, and (iv) after the plurality of fingers of the grounding tube outwardly radially pivot to the open position to electrically disengage the first conductor and disconnect the grounding path between the first conductor and the connector housing.

Additional features and advantages will be set forth in the detailed description which follows, and in part will be readily apparent to those skilled in the art from the description or recognized by practicing the embodiments as described in the written description and claims hereof, as well as the appended drawings.

It is to be understood that both the foregoing general description and the following detailed description are merely exemplary, and are intended to provide an overview or framework to understand the nature and character of the claims.

The accompanying drawings are included to provide a further understanding, and are incorporated in and constitute a part of this specification. The drawings illustrate one or more embodiments, and together with the description serve to explain principles and operation of the various embodiments.

DETAILED DESCRIPTION

Figure 1A:
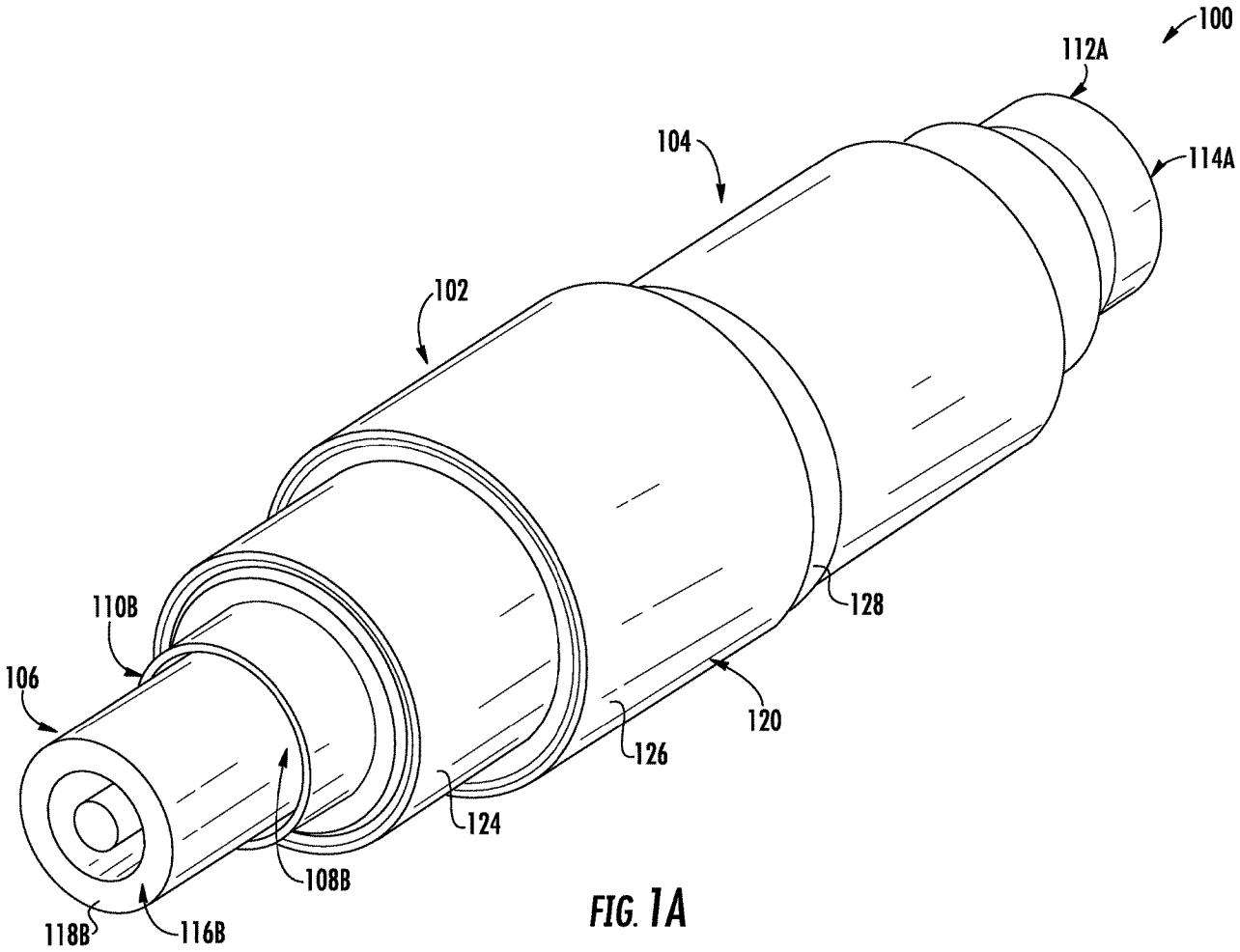
FIG. 1A is a perspective view of one embodiment of a connector subassembly, illustrating an exemplary coaxial connector mated with a first mating connector and a second mating connector, wherein the coaxial connector comprises a grounding tube to alter a ground path with a first conductor of the coaxial connector, and wherein the coaxial connector comprises a first mating interface at a first end, a second mating interface at a second end, a housing assembly therebetween, and an electrical trace assembly mounted within the housing assembly.

Embodiments of the disclosure are directed to coaxial connectors with a grounding tube for altering a ground path with a conductor of the coaxial connector. The coaxial connector is configured to establish a ground path before an electrical path between and through two mating connectors. In exemplary aspects disclosed herein, the coaxial connector comprises a connector housing with a first conductor mounted within the connector housing by a first conductor housing and a second conductor mounted within the connector housing by a second conductor housing. Further, the coaxial connector comprises a grounding tube mounted within the connector housing and around at least a portion of the first conductor to initially establish and subsequently disconnect a grounding path between the first conductor and the housing. In certain embodiments, the grounding tube comprises a plurality of fingers inwardly radially biased and movable between a closed position and an open position to make and break electrical contact with the first conductor. The initial grounding path shorts any potential electro-static discharge (ESD) that may result between the first conductor of the coaxial connector and the mating connector during mating therebetween. After the first conductor of the coaxial connector contacts the mating connector, the first conductor moves (e.g., axially translates), along with the first conductor housing, which moves the plurality of fingers from the closed position to the open position. As an example, this disconnects the grounding path between the first conductor and the connector housing and connects the first connector to the mating connector to establish an electrical path between the first conductor and the mating connector and through the coaxial connector. Thus, the coaxial connector can be grounded before establishing an electrical connection between and through the coaxial connector and a mating connector.

In this regard, FIGS. 1A-1D are views of one embodiment of a connector subassembly 100 illustrating an exemplary coaxial connector 102, a first mating connector 104, and a second mating connector 106. The coaxial connector 102 is configured to establish a ground path before an electrical path between and through the coaxial connector 102, the first mating connector 104, and/or the second mating connector 106. As discussed in more detail below, the coaxial connector 102 establishes the ground path with the first mating connector 104 before the coaxial connector 102 establishes the electrical path with the first mating connector 104 and through the coaxial connector 102 by use of one or more axially translating features (e.g., a grounding collar) and/or one or more radially translating features (e.g., a grounding tube). Establishing the grounding path between the coaxial connector 102 and the first mating connector 104 can short any potential ESD and/or discharge ESD build up before an electrical path is established between and through the coaxial connector 102 and the first mating connector 104. Further, the coaxial connector 102 compensates for tolerance stack variability through one or more axially translating electrical features (discussed below in more detail). As the coaxial connector 102 is mated with the first mating connector 104, the radially translating grounding feature is designed to initially establish a ground path with a conductor of the coaxial connector 102, and then subsequently disconnect the ground path. In certain embodiments, as the coaxial connector 102 is mated with the first mating connector 104, an axially translating grounding feature is designed to contact the first mating connector, and axially translate before the electrical feature contacts the first mating connector 104. Thus, the radially translating features and/or the axially translating features ground the coaxial connector 102 before establishing an electrical connection between and through the coaxial connector 102 and first mating connector 104 (while also compensating for tolerance stack variability in the coaxial connector 102).

The coaxial connector 102 comprises a first mating interface 108A at a first end 110A (also referred to as a coaxial connector first end, connector first end, etc.) for mating with the first mating connector 104 and a second mating interface 108B at a second end 110B (also referred to as a coaxial connector second end, connector second end, etc.) opposite the first end 110A for mating with the second mating connector 106. Similarly, the first mating connector 104 comprises a first mating interface 112A at a first end 114A and a second mating interface 112B at a second end 114B (opposite the first end). The first mating connector second mating interface 112B is configured to mate with the coaxial connector first mating interface 108A. Similarly, the second mating connector 106 comprises a first mating interface 116A (shown in FIG. 4A) at a first end 118A (shown in FIG. 4A) and a second mating interface 116B at a second end 118B (opposite the first end 118A). The second mating connector first mating interface 116A is configured to mate with the coaxial connector second mating interface 108B. In certain embodiments the second mating connector 106 comprises an SMPM (sub-miniature push-on, micro) connector (e.g., GPPO connector). For example, the second mating connector first mating interface 116A can comprise an SMPM female connector interface (e.g., socket) and the coaxial connector second mating interface 108B can comprise an SMPM male connector interface (e.g., pin).

Figure 1B:
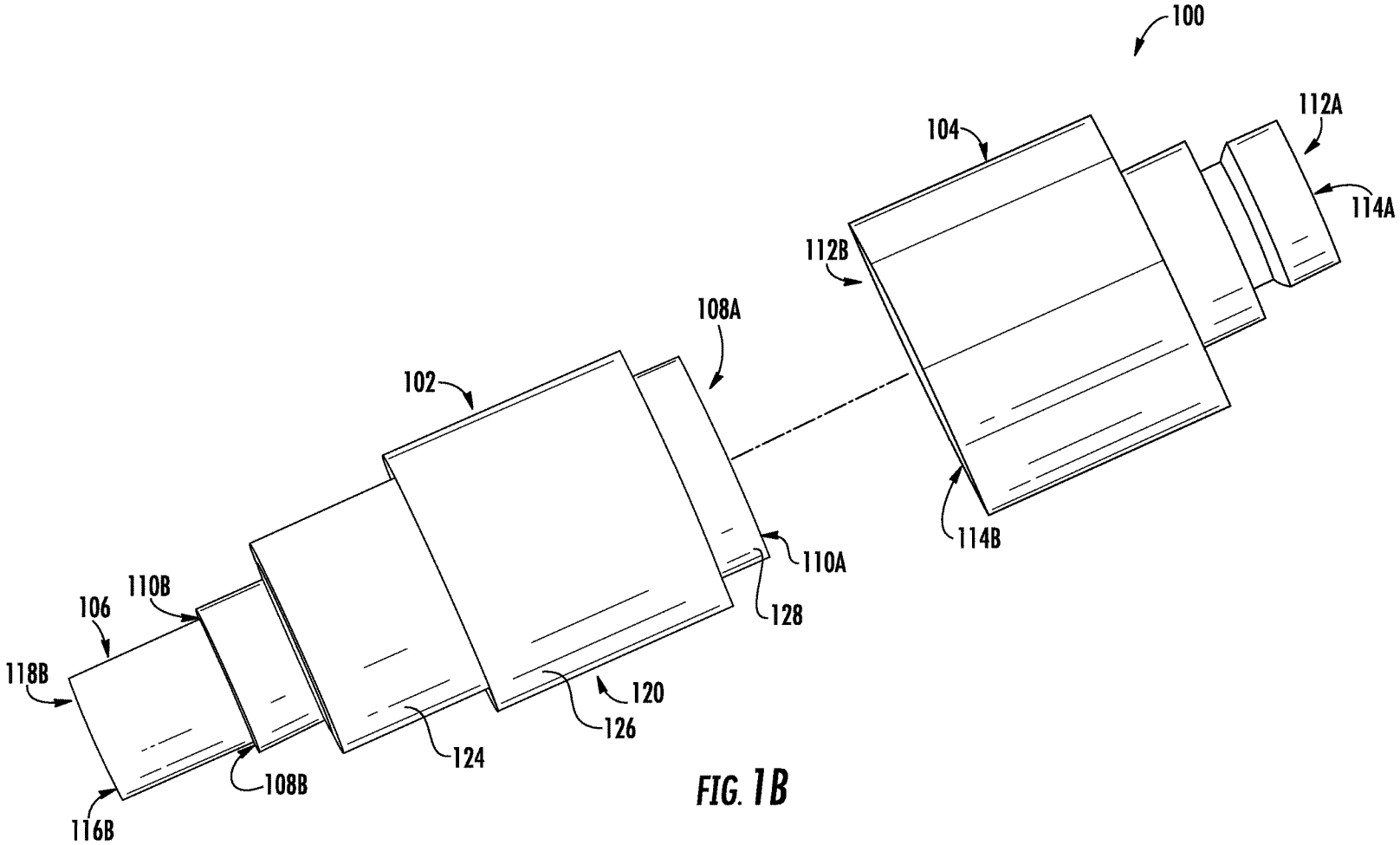
FIG. 1B is a side view of the coaxial connector and first mating connector of FIG. 1A separated from one another.
Figure 1C:
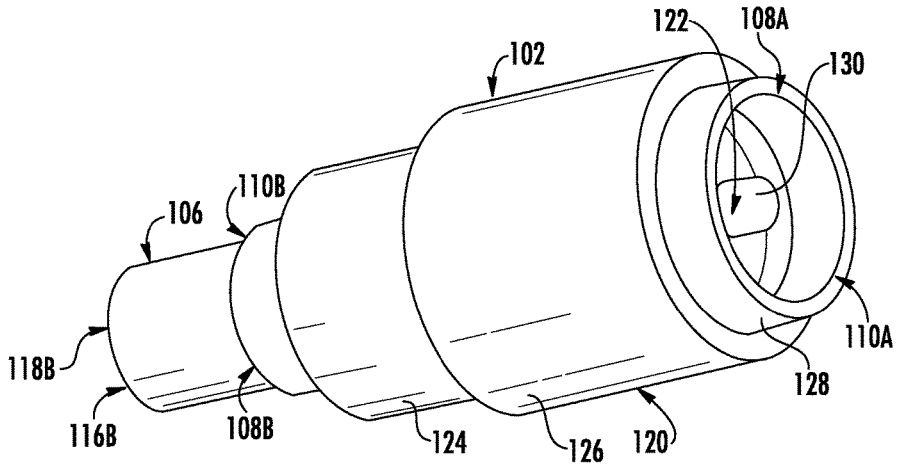
FIG. 1C is a perspective view of the first mating interface of the coaxial connector of FIG. 1A.
Figure 1D:
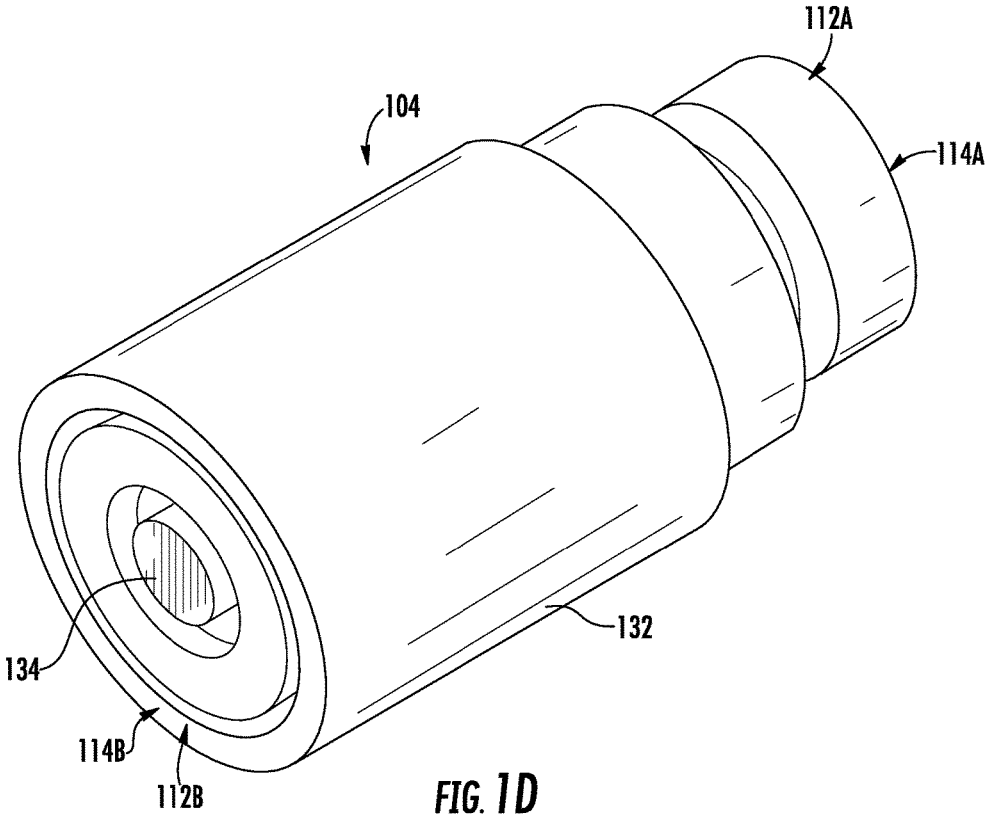
FIG. 1D is a perspective view of a first mating interface of the first mating connector of FIG. 1A.

FIG. 1A is a perspective view of the coaxial connector 102 mated with the first mating connector 104, and in particular, the coaxial connector first mating interface 108A mated with the first mating connector second mating interface 112B. Also shown, the coaxial connector 102 is mated with the second mating connector 106, and in particular, the coaxial connector second mating interface 108B connected with the second mating connector first mating interface 116A. FIGS. 1B-1D are views of the coaxial connector 102 disconnected from the first mating connector 104, and in particular, the coaxial connector first mating interface 108A disconnected from the first mating connector second mating interface 116B. Also shown is the coaxial connector 102 mated with the second mating connector 106, and in particular, the coaxial connector second mating interface 108B is connected with the second mating connector first mating interface 116A.

As shown in FIGS. 1A-1C, the coaxial connector 102 comprises a housing assembly 120 (e.g., shroud assembly, etc.) and an electrical trace assembly 122 housed within the housing assembly 120. The housing assembly 120 comprises a housing 124 (also referred to as a coaxial connector housing), an outer shell 126, and a grounding collar 128 (e.g., grounding feature) positioned therebetween. The outer shell 126 maintains attachment of the grounding collar 128 to the housing 124. The grounding collar 128 is mounted to, and in electrical communication with, the housing 124 to provide a grounding path between the coaxial connector 102 and the first mating connector 104 during mating that can discharge ESD build up before an electrical path is established between a first conductor 130 (e.g., electrical feature) and the first mating connector 104. The grounding collar 128 is biased towards the coaxial connector first end 110A (e.g., by a spring). Further, the grounding collar 128 is movable (e.g., axially translatable) relative to the housing 124 and is configured to move (e.g., axially translate) towards the coaxial connector second end 110B upon contact with the first mating connector 104. This axial translation allows the coaxial connector 102 to establish an electrical path with the first mating connector 104 after a grounding path has been established to discharge ESD build up before an electrical path is established, thereby protecting electrically connected equipment from an electrical surge and potential corresponding damage. However, should an ESD surge result before the grounding collar 128 has established a grounding path, the grounding tube (discussed in FIGS. 3A-4D below) would short the surge, thereby protecting electrically connected equipment.

As shown in FIG. 1C, the electrical trace assembly 122 comprises a first conductor 130 positioned within the housing 124 towards the coaxial connector first end 110A (forming a part of the coaxial connector first mating interface 108A). A portion of the first conductor 130 is positioned within the grounding collar 128 (explained in more detail below). The first conductor 130 is mounted within the housing 124. The first conductor 130 is configured to form an electrical path with the first mating connector 104 when the first conductor 130 contacts the first mating connector 104 and after the grounding tube (shown in FIGS. 3A-3C) disengages the first conductor 130 (explained in more detail below).

As shown in FIG. 1D, the first mating connector 104 comprises a housing 132 and a conductor 134 positioned within the housing 132. The coaxial connector first mating interface 108A and first mating connector first mating interface 112A are complementary configured such that the coaxial connector 102 and first mating connector 104 establish a ground path (e.g., grounding connection) before the coaxial connector 102 and first mating connector 104 establish an electrical path (e.g., signal path). More specifically, the coaxial connector grounding collar 128 is configured to contact the first mating connector housing 132 to establish a grounding path from the coaxial connector 102 to the first mating connector 104. In this manner, an end surface of the first mating connector housing 132 is planar with an end surface of the first mating connector conductor 134, whereas an end surface of the coaxial connector grounding collar 128 extends past an end surface of the coaxial connector first conductor 130, thereby ensuring that the grounding collar 128 contacts the first mating connector housing 132 before the coaxial connector first conductor 130 contacts the first mating connector conductor 134. However, other configurations are possible (e.g., where the end surface of the first mating connector housing 132 is non-planar with the end surface of the first mating connector conductor 134).

Upon contact with the first mating connector housing 132, the grounding collar 128 moves (e.g., translates) towards the coaxial connector second end 110B. After the grounding collar 128 moves (e.g., translates), the coaxial connector first conductor 130 contacts the first mating connector conductor 134 to establish an electrical path between the coaxial connector 102 and the first mating connector 104. Thus, the coaxial connector 102 is grounded before establishing an electrical connection between the coaxial connector 102 and the first mating connector 104 (and the second mating connector 106). Thus, a continuous and reliable electrical and grounding contact between the connectors 102, 104, 106 can be made through the coaxial connector 102. However, as noted above, should an ESD surge result before the grounding collar 128 has established a grounding path, the grounding tube (discussed in FIGS. 3A-4D below) would short the surge, thereby protecting electrically connected equipment.

Figure 2:
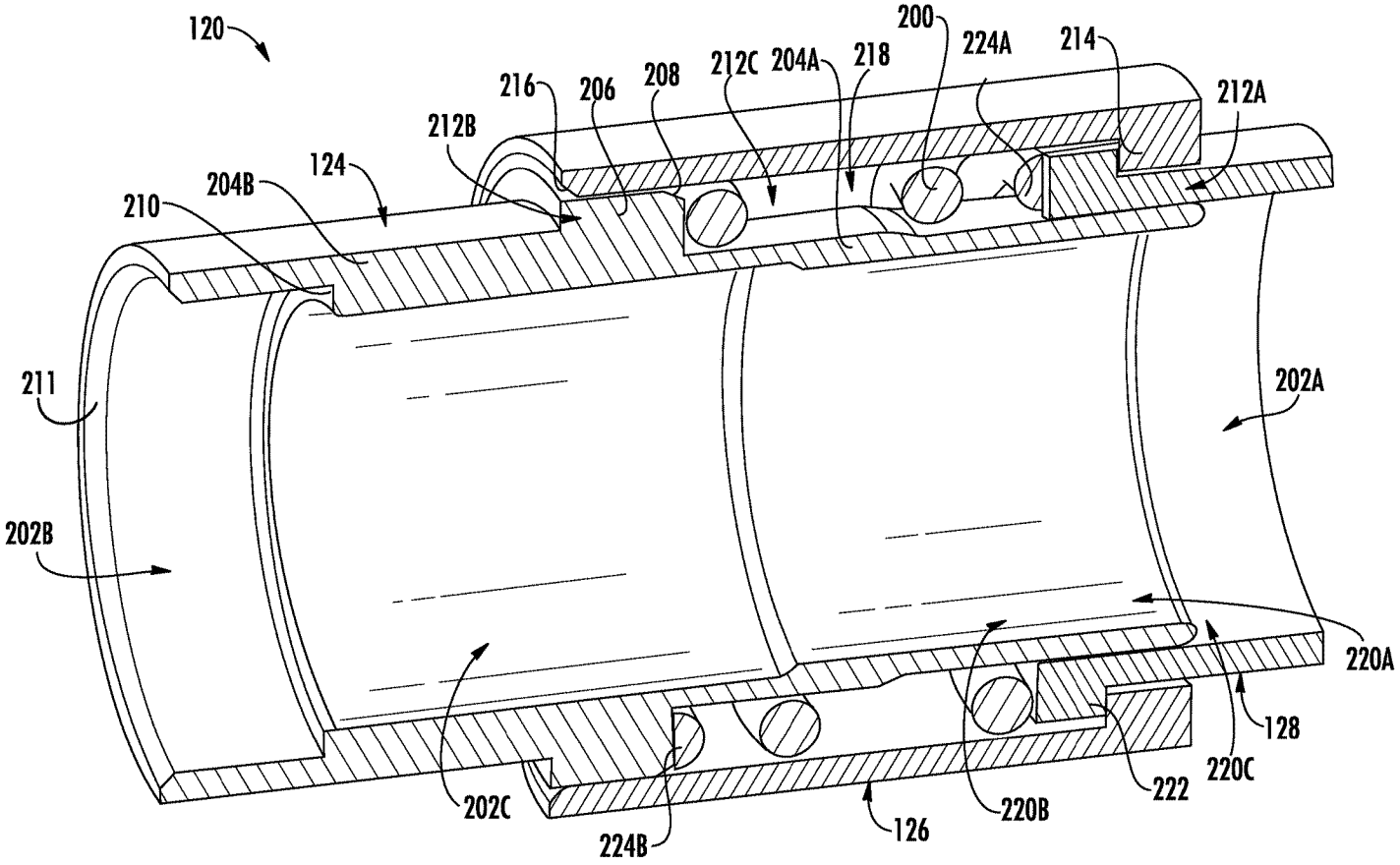
FIG. 2 is a cross-sectional perspective view of the housing assembly of the coaxial connector of FIGS. 1A-1D.

FIG. 2 is a cross-sectional perspective view of the housing assembly 120 of the coaxial connector 102 of FIGS. 1A-1D. The housing assembly 120 contains the electrical trace assembly 122 (not shown) and establishes a grounding path with the first mating connector 104. In particular, the housing assembly 120 establishes a ground path with the first conductor 130 via a grounding tube (shown in FIGS. 3A-3C) and/or a grounding collar 128, as discussed in more detail below. The housing assembly 120 comprises the housing 124, the outer shell 126, the grounding collar 128, and an outer spring 200 (e.g., first spring). The housing 124 contains the electrical trace assembly 122, is generally cylindrical, and defines a first opening 202A at a first end (also referred to as a connector housing first end) (towards the coaxial connector first end 110A), a second opening 202B at a second end (also referred to as a connector housing second end) (opposite the first end and towards the coaxial connector second end 110B), and a generally cylindrical interior 202C therebetween. The housing 124 further comprises a first portion 204A towards the first opening 202A, a second portion 204B towards the second opening 202B, and an outer shoulder 206 outwardly extending (e.g., generally perpendicularly) from an external surface of the housing 124 between the first portion 204A and the second portion 204B. The outer shoulder 206 may comprise a chamfer 208 towards the first opening 202A to facilitate assembly of the outer shell 126 to the housing 124 (explained in more detail below). The second portion 204B may comprise an inner shoulder 210 positioned between an end of the second portion 204B and the outer shoulder 206. The inner shoulder 210 provides a mounting surface for the electrical trace assembly 122 (explained below in more detail). Further, the second opening 202B may include an inner chamfer 211 along an interior edge of the rim to facilitate assembly of the electrical trace assembly 122 within the housing interior 202C.

The outer shell 126 maintains attachment of the grounding collar 128 to the housing 124, is generally cylindrical, and defines a first opening 212A at a first end (e.g., towards the coaxial connector first end 110A), a second opening 212B at a second end (opposite the first end and towards the coaxial connector second end 110B), and a generally cylindrical interior 212C therebetween. The outer shell 126 further comprises an inward annular flange 214 proximate the first end and defining the first opening 212A to maintain attachment of the grounding collar 128 to the housing 124. In this manner, the size (e.g., diameter) of the first opening 212A is smaller than the second opening 212B. An interior surface of the outer shell 126 (towards the second opening 212B) is frictionally engaged with an exterior surface of the housing outer shoulder 206. Accordingly, the outer shell 126 is fixedly attached to the housing 124 and defines a gap 218 (e.g., gap region, divide, etc.) between the outer shell 126 and the housing first portion 204A to retain a portion of the grounding collar 128 within the gap 218. Further, the second opening 212B may include an inner chamfer 216 along an interior edge of the rim to facilitate assembly of the outer shell 126 to the grounding collar 128. More specifically, the outer shell inner chamfer 216 interacts with the housing outer shoulder chamfer 208 to facilitate the assembly as the outer shoulder 206 is slid into the outer shell second opening 212B.

The grounding collar 128 establishes a grounding path with the first mating connector 104, is generally cylindrical, and defines a first opening 220A at a first end (e.g., towards the coaxial connector first end 110A), a second opening 220B at a second end (opposite the first end and towards the coaxial connector second end 110B), and a generally cylindrical interior 220C therebetween. The grounding collar 128 further comprises an outward annular flange 222 proximate the second opening 220B first end to maintain attachment of the grounding collar 128 to the housing 124. When assembled, as shown, a portion of the housing 124 (e.g., the housing first opening 202A) is positioned within the grounding collar interior 220C, with the grounding collar outward annular flange 222 positioned within the gap 218. In this manner, the grounding collar 128 is movable (e.g., axially translatable) relative to the housing 124 where the grounding collar outward annular flange 222 has clearance for moving (e.g., translating) within the gap 218. However, the grounding collar 128 is prevented from disengaging from the housing 124 and the grounding collar 128 by the interaction of the grounding collar outward annular flange 222 with the outer shell inward annular flange 214. In other words, the outer shell first opening 212A is larger than an external diameter of the grounding collar 128 (e.g., proximate the grounding collar first opening 220A) but smaller than an external diameter of the grounding collar outward annular flange 222. In this manner, the grounding collar 128 cannot disengage from the housing 124.

The outer spring 200 biases the grounding collar 128 relative to the housing 124 towards the coaxial connector first end 110A, and comprises a first flat end surface 224A at a first end and a second flat end surface 224B at a second end (opposite the first end). As shown, the outer spring 200 is positioned within the gap 218 with the first flat end surface 224A positioned towards the coaxial connector first end 110A and contacting the grounding collar 128 (proximate the grounding collar second opening 220B). The second flat end surface 224B is positioned towards the coaxial connector second end 110B and contacting the housing outer shoulder 206. In this manner, the outer spring 200 biases the grounding collar 128 towards the coaxial connector first end 110A, but is compressible such that the grounding collar 128 can axially translate within the gap 218. Further, the outer spring 200 provides continuous grounding contact between the grounding collar 128 and the housing outer shoulder 206. The first and second flat end surfaces 224A, 224B help facilitate an even, constant contact between the grounding collar 128 and the housing outer shoulder 206, minimize the length of the outer spring 200, provides a lower solid height of the outer spring 200, and spreads out the biasing force.

However, even with the grounding collar 128, electrical surges may occur as the coaxial connector 102 is mated to the first mating connector 104 where an ESD is generated across the conductors of the coaxial connector 102 and the first mating connector 104 before the grounding collar 128 of the coaxial connector 102 contacts the first mating connector 104. As explained in more detail below, the grounding tube (shown in FIGS. 3A-4D) shorts any potential ESD that may result, thereby protecting from damage the coaxial connector 102 and any electronic equipment in electrical communication with the coaxial connector 102.

Figure 3A:
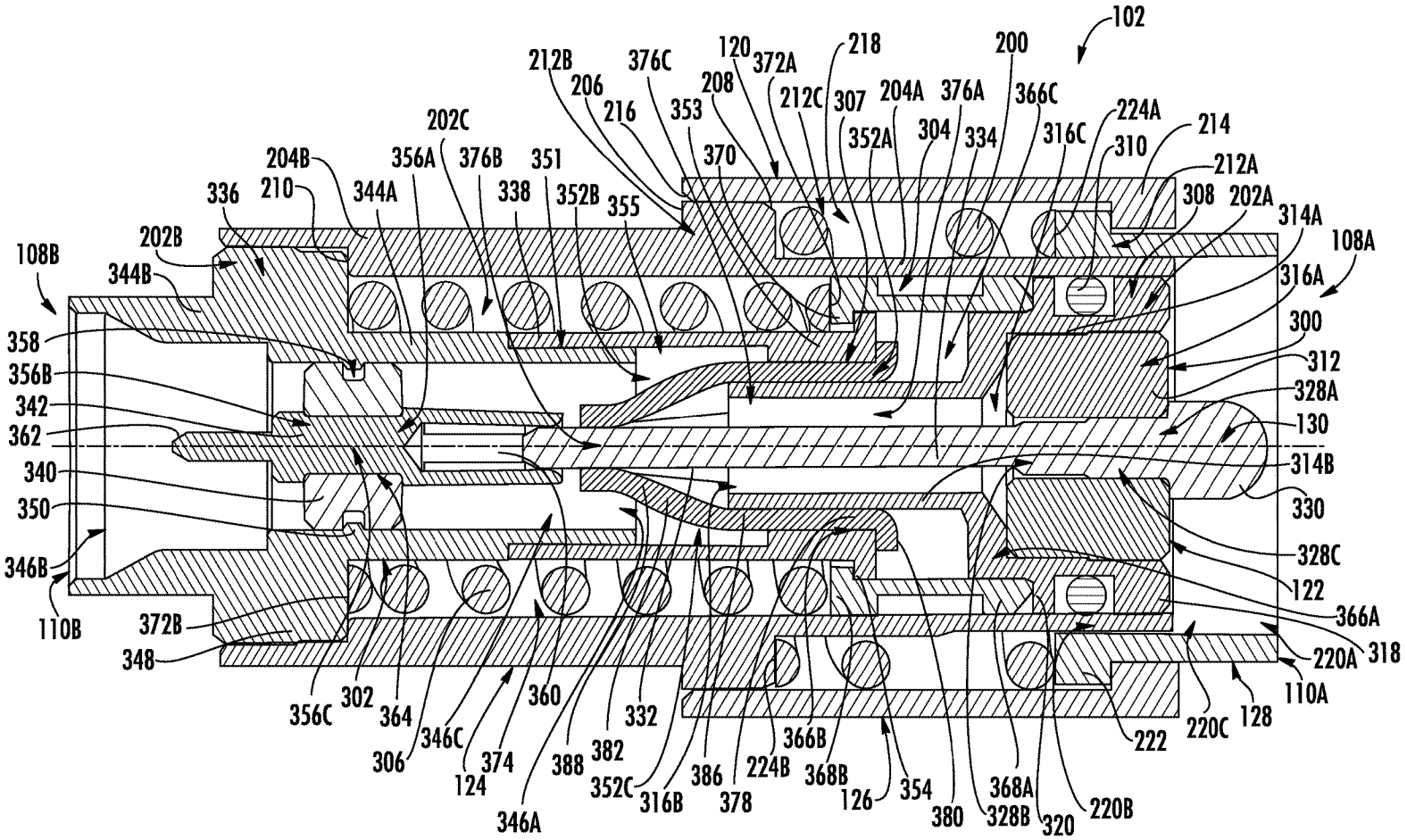
FIG. 3A is a cross-sectional side view of the coaxial connector of FIGS. 1A-1D, illustrating assembly of the housing assembly with the electrical trace assembly, wherein the housing assembly comprises a housing and a grounding collar, and the electrical trace assembly comprises a first conductor, a second conductor, and a grounding tube mounted within the housing.

FIG. 3A is a cross-sectional side view of the coaxial connector 102 of FIGS. 1A-1D, illustrating assembly of the housing assembly 120 with the electrical trace assembly 122. The electrical trace assembly 122 establishes an electrical path from the first mating connector 104 through the coaxial connector 102 to the second mating connector 106. The electrical trace assembly 122 comprises a first conductor subassembly 300, a second conductor subassembly 302, an intermediate bushing 304, an inner spring 306 (e.g., second spring), and a grounding tube 307. As explained in more detail below, the grounding tube 307 establishes and disconnects a ground path between the first conductor 130 and the housing 124. Accordingly, any ESD across conductors of the coaxial connector 102 and the first mating connector 104 would be shorted to the housing 124 via the grounding tube 307. After a ground path is established between the coaxial connector 102 and the first mating connector 104, the ground path is disconnected between the first conductor 130 and the housing 124, which thereby establishes an electrical path between the first conductor 130 and the first mating connector 104.

The first conductor assembly 300 is positioned towards the coaxial connector first end 110A (e.g., proximate and/or within the housing first opening 202A), and the second conductor subassembly 302 is positioned towards the coaxial connector second end 110B (e.g., proximate and/or within the housing second opening 202B). The first conductor subassembly 300 and second conductor subassembly 302 are connected to one another by the intermediate bushing 304, and axially biased from one another by an inner spring 306. The first conductor subassembly 300 and second conductor subassembly 302 interact with each other to establish an electrical path therebetween (explained below in more detail).

Each of the first conductor subassembly 300 and second conductor subassembly 302 is mounted within the housing 124, and electrically connected to each other, even when disconnected from the first mating connector 104 (explained in more detail below). The first conductor subassembly 300 and second conductor subassembly 302 are configured to form an electrical path with the first mating connector 104 after establishing a ground path with the first mating connector 104. In particular, the first conductor subassembly 300 is configured to move (e.g., axially translate) towards the second conductor subassembly 302 (e.g., and towards the coaxial connector second end 110B) to compensate for tolerance stack variability, to move fingers of the grounding tube 307 to disconnect the ground path between the first conductor 130 and the housing 124, and to establish an electrical path between the coaxial connector 102 and the first mating connector 104 (discussed in more detail below).

The first conductor subassembly 300 comprises a first conductor housing 308, an O-ring 310 (e.g., gasket) positioned external to the first conductor housing 308, a first conductor dielectric cylinder 312 positioned within the first conductor housing 308, and the first conductor 130 mounted within the first conductor dielectric cylinder 312. The first conductor housing 308 is in grounding connection with the housing assembly 120. The O-ring 310 seals the connector housing 124 from the environment and ensures proper operation and functioning of the coaxial connector 102. The first conductor dielectric cylinder 312 mounts the first conductor 130 within the first conductor housing 308 and electrically insulates the first conductor 130 from the first conductor housing 308 (when the grounding tube 307 is disengaged from the first conductor 130).

The first conductor housing 308 mounts the first conductor 130 within the housing assembly 120. The first conductor housing 308 is in grounding connection with the housing assembly 120. The first conductor housing 308 comprises a first portion 314A defining a first opening 316A at a first end (also referred to as a conductor housing first end, first conductor housing first end, etc.) (e.g., towards the coaxial connector first end 110A), a second portion 314B defining a second opening 316B at a second end (also referred to as a conductor housing second end, first conductor housing second end, etc.) (e.g., opposite the first end and towards the coaxial connector second end 110B), and an interior 316C positioned between the first opening 316A and the second opening 316B. The first conductor housing first portion 314A frictionally engages the first conductor dielectric cylinder 312 to fixedly mount the first conductor dielectric cylinder 312 within the interior 316C. The first portion 314A comprises an outer annular flange 318 proximate the first opening 316A, and an outer annular protrusion 320 positioned between the outer annular flange 318 and the second cylindrical portion 314B to retain the O-ring 310. The O-ring 310 is positioned and retained between the outer annular flange 318 and the outer annular protrusion 320 and remains therebetween as the first conductor housing 308 moves (e.g., axially translates) relative to the connector housing 124. The second cylindrical portion 314B comprises a constant diameter positioned within the grounding tube 307 which, when moved (e.g., axially translated), moves the fingers of the grounding tube 307 (discussed in more detail below) to disengage the grounding tube 307 from the first conductor 130.

The first conductor dielectric cylinder 312 mounts the first conductor 130 within the first conductor housing 308 and electrically insulates the first conductor 130 from the first conductor housing 308 (when the grounding tube 307 is disengaged from the first conductor 130). The first conductor dielectric cylinder 312 is generally cylindrical and defines a first opening 328A at a first end (towards the coaxial connector first end 110A), a second opening 328B at a second end (opposite the first end and towards the coaxial connector second end 110B), and a generally cylindrical interior 328C therebetween. As shown, the first conductor dielectric cylinder 312 mounts the first conductor 130 within the interior 328C.

The first conductor 130 comprises a first male hemispherical contact 330 at a first end, a second male cylindrical contact 332 at a second end, and a rod 334 therebetween. As shown, the first male hemispherical contact 330 is configured to contact the first mating connector 104 (and establish an electrical path therebetween). The first male hemispherical contact 330 is positioned towards the coaxial connector first end 110A, within the grounding collar 128 (e.g., within the grounding collar interior 220C), but exterior to the connector housing 124, the first conductor housing 308 (e.g., first conductor housing first portion 314A), and/or the first conductor dielectric cylinder 312. It is noted that the coaxial connector 102 is configured to minimize the distance between the grounding collar 128 and the electrical signal path (e.g., first conductor 130). This increases the operational reliability of the coaxial connector 102 when mated with the first mating connector 104.

The first conductor 130 is configured to contact and mate with the first mating connector 104. The position of the first male hemispherical contact 330 allows the grounding collar 128 to establish a grounding path before the first male hemispherical contact 330 establishes an electrical path, but also provides a point of electrical contact after the grounding collar 128 moves (e.g., axially translates) relative to the connector housing 124 and/or first male hemispherical contact 330.

The rod 334 extends through the first conductor housing 308 (e.g., through the first conductor dielectric cylinder 312) without contacting the first conductor housing 308. This ensures that the first conductor 130 does not contact the first conductor housing 308 and insulates the grounding path from the electrical path (when the grounding tube 307 is disengaged from the first conductor 130). As shown, the second male cylindrical contact 332 extends past the first conductor housing second opening 316B, and is positioned within the intermediate bushing 304, within the second conductor subassembly 302.

The second conductor subassembly 300 comprises a second conductor housing 336, a second conductor bushing 338, a second conductor dielectric cylinder 340, and a second conductor 342 (e.g., electrical feature). The second conductor housing 336 mounts the second conductor 342 within the housing assembly 120. The second conductor housing 336 is in grounding connection with the housing assembly 120. The second conductor bushing 338 attaches the second conductor subassembly 302 to the intermediate bushing 304 (and prevents disengagement of the first conductor subassembly 300 from the housing assembly 120). Further, the second conductor bushing 338 provides clearance for the fingers of the grounding tube 307 to move (explained in more detail below). The second conductor dielectric cylinder 340 mounts the second conductor 342 within the second conductor housing 336 and electrically insulates the second conductor 342 from the second conductor housing 336.

The second conductor housing 336 comprises a first portion 344A defining a first opening 346A at a first end (also referred to as a conductor housing first end, second conductor housing second end, etc.) (e.g., towards the coaxial connector first end 110A), a second portion 344B defining a second opening 346B at a second end (also referred to as a conductor housing second end, second conductor housing second end, etc.) (e.g., opposite the first end and towards the coaxial connector second end 110B), an interior 346C positioned between the first opening 346A and the second opening 346B, and an outer shoulder 348 positioned between the first portion 344A and the second portion 344B. The outer shoulder 348 is positioned within the housing second opening 202B and frictionally engaged with the connector housing 124, thereby fixedly attaching the second conductor housing 336 to the connector housing 124. Further the second conductor housing 336 contacts the housing second portion inner shoulder 210, which provides a stopping point when inserting the second conductor housing 336 into the connector housing 124 (e.g., preventing over insertion). The first portion 344A comprises an inner annular protrusion 350 to engage and mount the second conductor dielectric cylinder 340 to the second conductor housing 336. Further, the first portion 344A comprises an outer recess 351 proximate the first opening 346A to frictionally engage the second conductor bushing 338.

The second conductor bushing 338 defines a first opening 352A at a first end (towards the coaxial connector first end 110A), a second opening 352B at a second end (opposite the first end and towards the coaxial connector second end 110B), and a generally cylindrical interior 352C therebetween. The second conductor bushing 338 further comprises an inner shoulder 353 proximate the first opening 352A. The second conductor bushing 338 further comprises an outer annular flange 354 proximate the first opening 352A, which extends past an external surface of the second conductor housing 336 to interact with the intermediate bushing 304. The outer annular flange 354 attaches the second conductor housing 336 to the intermediate bushing 304 (and prevents disengagement of the first conductor subassembly 300 from the housing assembly 120).

The outer recess 351 of the first portion 344A of the second conductor housing 336 is inserted into and frictionally engaged with the second opening 352B of the second conductor bushing 338. The outer recess 351 provides for an outer surface of the second conductor housing 336 to be generally aligned or parallel with an outer surface of the second conductor bushing 338. When assembled, the second conductor housing 336 and the second conductor bushing 338 define an inner groove 355 between a first end of the second conductor housing 336 (proximate the first opening 346A) and the inner shoulder 353 of the second conductor bushing 338 to provide clearance for the fingers of the grounding tube 307 to outwardly pivot (explained in more detail below). The second conductor housing 336 and the second conductor bushing 338 are shown as two separate pieces for ease of machining the inner groove 355. However, in certain embodiments, the second conductor housing 336 and the second conductor bushing 338 are integrally connected (such that the second conductor bushing 338 is part of the second conductor housing 336).

The second conductor dielectric cylinder 340 mounts the second conductor 342 within the second conductor housing 336 and electrically insulates the second conductor 342 from the second conductor housing 336 (when the grounding tube 307 is disengaged from the first conductor 130). The second conductor dielectric cylinder 340 is generally cylindrical and defines a first opening 356A at a first end (towards the coaxial connector first end 110A), a second opening 356B at a second end (opposite the first end and towards the coaxial connector second end 110B), and a generally cylindrical interior 356C therebetween. The second conductor dielectric cylinder 340 further comprises an outer annular groove 358 which receives the second conductor housing inner annular protrusion 350 therein to fixedly attach the second conductor dielectric cylinder 340 to the second conductor housing 336. As shown, the second conductor dielectric cylinder 340 mounts the second conductor 342 therein, and electrically insulates the second conductor 342 from the second conductor housing 336.

The second conductor 342 comprises a female socket contact 360 at a first end (towards the coaxial connector first end 110A), a male contact 362 at a second end (opposite the first end and towards the coaxial connector second end 110B), and an external mounting recess 364 positioned therebetween. The second conductor 342 is axially aligned with the first conductor 130. The female socket contact 360 is configured to mate with and receive the first conductor second male cylindrical contact 332 therein when the first conductor 130 moves (e.g., axially translates) towards the second conductor 342. Further, the female socket contact 360 could include tapered inner sidewalls to provide a tight fit with the first conductor second male cylindrical contact 332. The second conductor male contact 362 is configured to contact and mate with the second mating connector 106. The second conductor mounting recess 364 is configured to be positioned within the second conductor dielectric cylinder interior 356 to fixedly attach the second conductor 342 relative to the second conductor dielectric cylinder 340.

As mentioned above, the first conductor subassembly 300 is attached to the second conductor subassembly 302 by the intermediate bushing 304. The intermediate bushing 304 defines a first opening 366A at a first end (towards the coaxial connector first end 110A), a second opening 366B at a second end (opposite the first end and towards the coaxial connector second end 110B), and a generally cylindrical interior 366C therebetween. The intermediate bushing 304 comprises a first outer annular flange 368A proximate the first opening 366A at the first end and a second outer annular flange 368B proximate the second opening 366B at the second end. The first and second outer annular flanges 368A, 368B decrease the surface area contact between the intermediate bushing 304 and the inner surface of the connector housing 124. This decreases the resistance force as the first conductor subassembly 300 moves (e.g., axially translates) relative to the connector housing 124. The intermediate bushing 304 further comprises an inner annular flange 370 proximate the second opening 366B at the second end, which interacts with the second conductor bushing 338 to attach the first conductor subassembly 300 to the second conductor subassembly 302 and prevent disengagement of the first conductor subassembly 300 from the connector housing 124.

The first conductor housing first portion 314A is positioned within the intermediate bushing first opening 366A, thereby frictionally and fixedly attaching the first conductor subassembly 300 to the intermediate bushing 304. The second conductor bushing outer annular flange 354 is positioned within the intermediate bushing interior 366C. The outer diameter of the second conductor bushing outer annular flange 354 is smaller than the interior diameter of the intermediate bushing 304 but larger than the intermediate bushing inner annular flange 370. Further, the second conductor housing first portion 344A is positioned within the intermediate bushing second opening 366B (e.g., the diameter of the intermediate bushing inner annular flange 370 is larger than the diameter of the intermediate bushing second opening 366B). In this manner, the second conductor subassembly 302 is attached to the intermediate bushing 304 but allows movement (e.g., axial translation) of the second conductor subassembly 302 relative to the intermediate bushing 304 and first conductor subassembly 300.

The inner spring 306 biases the first conductor subassembly 300 towards the coaxial connector first end 110A. The inner spring 306 comprises a first flat end surface 372A at a first end and a second flat end surface 372B at a second end (opposite the first end). The inner spring 306 is positioned within a gap 374 defined between the outer surface of the second conductor housing first portion 344A and the inner surface of the connector housing 124. The inner spring 306 is axially aligned with the outer spring 200 but has a smaller diameter so that they can overlap (e.g., a portion of the inner spring 306 can be nested in a portion of the outer spring 200), which can decrease the length of the coaxial connector 102. The first flat end surface 372A contacts the second end of the intermediate bushing 304 proximate the second opening 366B. The second flat end surface 372B contacts the second conductor housing outer shoulder 348. In this manner, the inner spring 306 biases the first conductor subassembly 300 towards the coaxial connector first end 110A, but is compressible such that the first conductor subassembly 300 moves (e.g., axially translates) within the gap 374 (towards the coaxial connector second end 110B). Further, the inner spring 306 provides continuous grounding contact between the intermediate bushing 304 and the second conductor housing outer shoulder 348. The first and second flat end surfaces 372A, 372B help facilitate an even constant contact between the intermediate bushing 304 and the second conductor housing outer shoulder 348, minimizes the length of the inner spring 306, provide a lower solid height of the outer spring 200, and spread out the biasing force.

In this manner, the first conductor 130 and the grounding collar 128 are independently biased (e.g., spring-biased) towards the coaxial connector first end 110A to establish the grounding path before the electrical path (explained in more detail below) and to compensate for tolerance stack variability in the coaxial connector 102. In particular, during manufacturing, each component of the coaxial connector 102 has a certain tolerance (e.g., variability) despite being of the same make and manufacture. Accordingly, the coaxial connector 102 as a whole includes tolerance stack variability where each of these component tolerances compound. As a result, for coaxial connectors 102 of the same make and manufacture, there can be variability of an end of the first conductor 130 (e.g., first male hemispherical contact 330) relative to an end of the grounding collar 128. Movement (e.g., axial translation) of the first conductor 130 allows for the coaxial connector 102 to compensate for this variability when making a connection between the coaxial connector 102 and the first mating connector 104. As noted above, should an ESD surge result before the grounding collar 128 has established a grounding path, the grounding tube 307 would short the surge, thereby protecting electrically connected equipment.

Figure 3B:
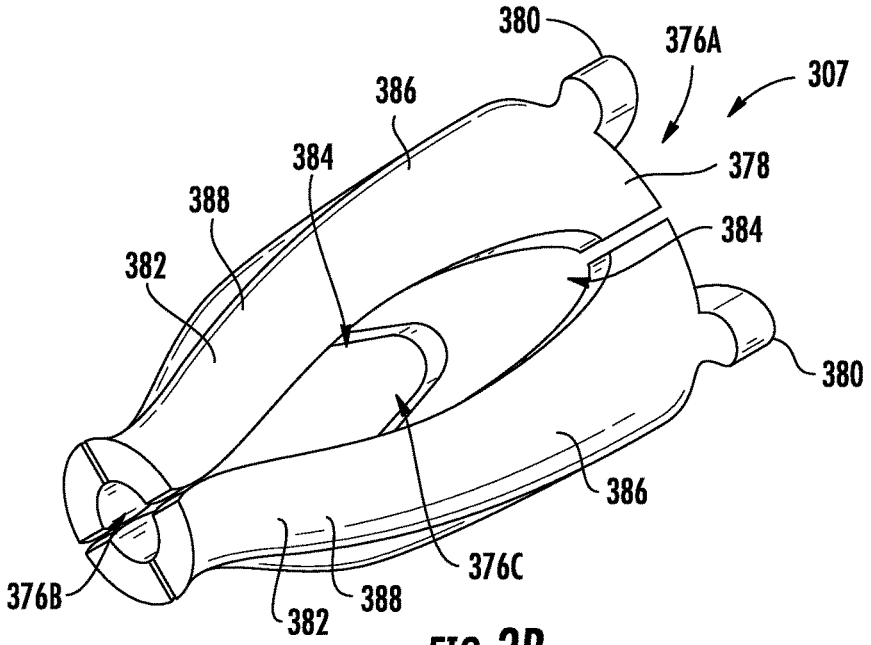
FIG. 3B is a perspective view of the grounding tube of FIG. 3A.
Figure 3C:
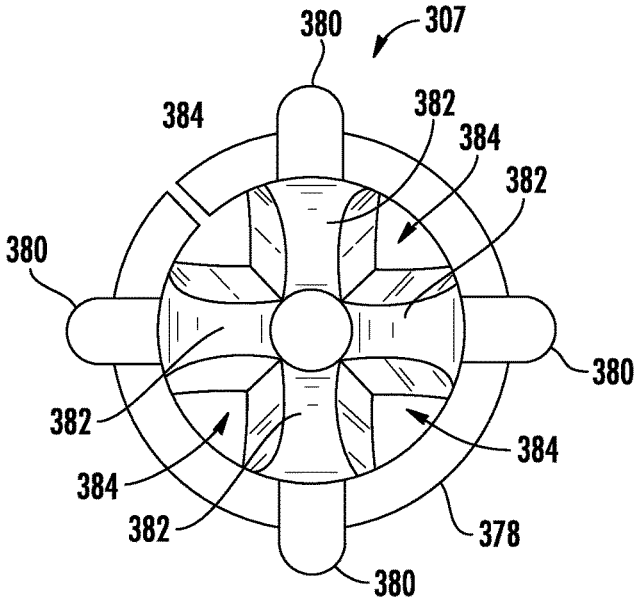
FIG. 3C is a front view of the grounding tube of FIG. 3A.

Referring to FIGS. 3A-3C, the grounding tube 307 defines a first opening 376A at a first end (towards the coaxial connector first end 110A), a second opening 376B at a second end (opposite the first end and towards the coaxial connector second end 110B), and an interior 376C therebetween. The grounding tube 307 comprises a body 378 generally cylindrically shaped, a plurality of outer nubs 380 circumferentially positioned proximate the first opening 376A at the first end (also referred to as the ground tube first end, tube first end, etc.), a plurality of fingers 382 (also referred to as spring fingers, spring contacts, circuit effecting contact, etc.) at the second end (also referred to as the ground tube second end, tube second end, etc.) and a plurality of channels 384 defined between the plurality of fingers 382. The plurality of fingers 382 includes a straight portion 386 forming a generally cylindrical shape to receive the first conductor housing 308 therein. The plurality of fingers further include an angled portion 288 which forms a generally conical shape (when in the closed position) and defines the second opening 376B. Further, the plurality of fingers 382 are inwardly biased and elastically deformable (as explained in more detail below).

The body 378 is positioned within the first opening 352A of the second conductor bushing 338, such that the plurality of outer nubs 380 are positioned outside the first opening 352A of the second conductor bushing 338. The body 378 is frictionally engaged with the inner shoulder 353 of the second conductor bushing 338. The outer periphery of the plurality of outer nubs 380 is larger than the first opening 352A of the second conductor bushing 338 to prevent the grounding tube 307 from moving (e.g., axially translating) towards the coaxial connector second end 110B, such as when the first conductor housing 308 moves (e.g., axially translates) towards the coaxial connector second end 110B. In an uncompressed position, at least a portion of the second portion 314B of the first conductor housing 308 is positioned within the body 378 of the grounding tube 307, but not in contact with the plurality of fingers 382. Further, in an uncompressed position, the rod 334 of the first conductor 130 is in electrical contact with the plurality of fingers 382 of the grounding tube 307, and at least a portion of the rod 334 of the first conductor 130 is positioned within and extends through the first opening 376A, the second opening 376B, and the interior 376C of the grounding tube 307. Thus, in an uncompressed position, a grounding path is formed between the first conductor 130, the grounding tube 307, and the housing 124. More specifically, a grounding path is formed between the first conductor 130, the grounding tube 307, the second conductor bushing 338, the second conductor housing 336, the housing 124, the outer shell 126, and the grounding collar 128. In the event of an ESD, the surge would be shorted through the grounding tube 307 to the housing 124. As explained below in more detail, in a compressed position, the second portion 314B of the first conductor housing 308 forces the plurality of fingers 382 (the angled portion 388) to outwardly pivot because an outer periphery of the second portion 314B is larger than the second opening 376B defined by the plurality of fingers 382.

FIGS. 4A-4D are views of the coaxial connector 102 mating with the first mating connector 104 to form the assembled connector assembly 100, and establishing a grounding path and electrical path from the first mating connector 104 to the second mating connector 106 through the coaxial connector 102. Alignment and mating of this particular first mating connector 104 with the coaxial connector 102 could be the result of an environmental structure. For example, coaxial connector 102 may be positioned in a first half of a clamshell device, and the first mating connector 104 may be positioned in a second half of a clamshell device, such that their positioning within the clamshell device aligns the coaxial connector 102 with the first mating connector 104. Accordingly, closing the clamshell device mates the coaxial connector 102 with the first mating connector 104.

The first mating connector 104 comprises the housing 132, a dielectric 400 positioned within the housing 132, the first conductor 130 positioned within the dielectric 400, and an insulator 402. The housing 132 comprises a first opening 404A at a first end (towards a first mating interface 112A), a second opening 404B at a second end (opposite the first end and towards the second mating interface 112B), and an interior 404C therebetween. The dielectric 400 comprises a first opening 406A at a first end (towards a first mating interface 112A), a second opening 406B at a second end (opposite the first end and towards the second mating interface 112B), and an interior 406C therebetween. Further, the dielectric 400 comprises a recess 408 at the second end (proximate the second opening 406B). The conductor 134 comprises a first male contact 410A at a first end (towards the first mating interface 112A) and a second male contact 410B at a second end (opposite from the first end and towards the second mating interface 112B). The second male contact 410B sits within the recess 408 such that an end surface of the second male contact 410B is approximately planar with an end surface of the first mating connector housing 132. Of course, other configurations could be used, and the relative positioning of the grounding collar 128 and first conductor 130 could be correspondingly altered. The insulator 402 is positioned towards the first mating interface 112A, partially positioned within the dielectric 400, and the conductor 134 extends through the insulator 402.

Figure 4A:
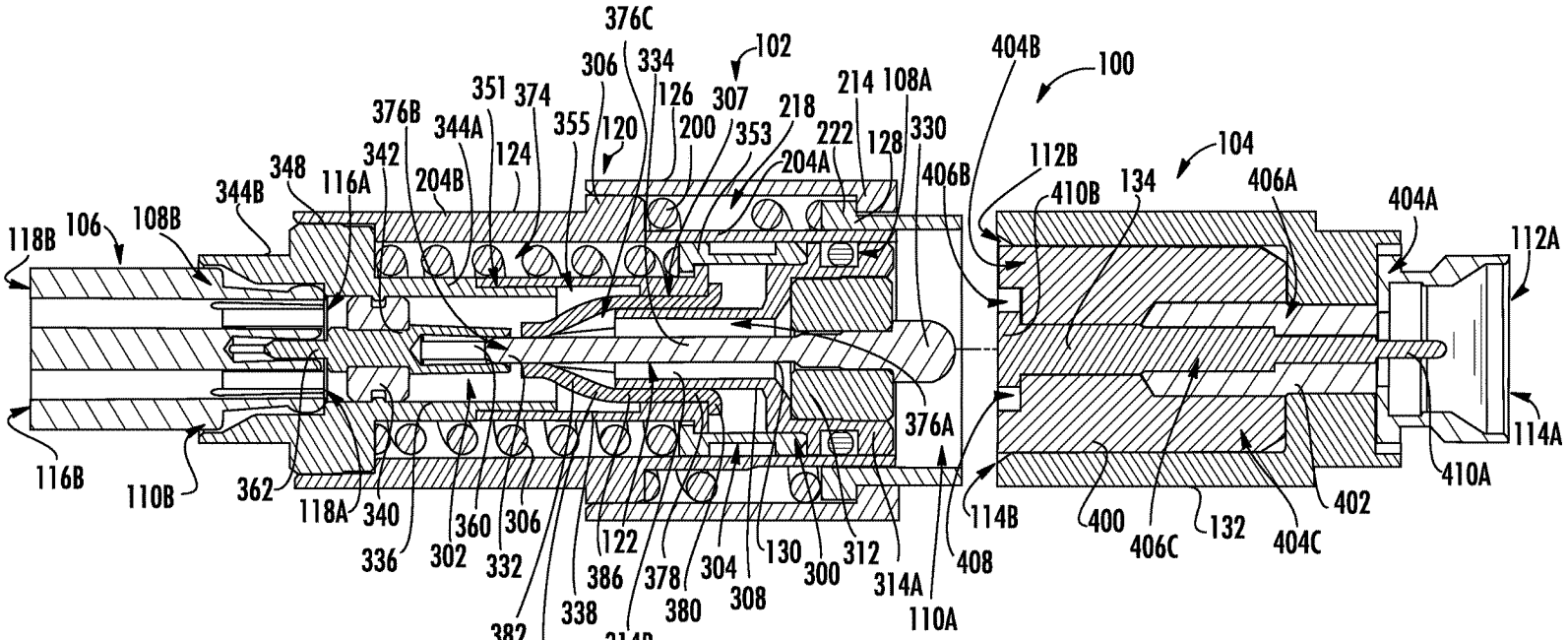
FIG. 4A is a cross-sectional side view of the coaxial connector of FIGS. 1A-3, illustrating the coaxial connector second mating interface engaged with a second mating connector, and the coaxial connector first mating interface disengaged from the first mating connector of FIGS. 1A-1D.

In FIG. 4A, the coaxial connector second mating interface 108B is engaged with the second mating connector 106 and the coaxial connector first mating interface 108A is disengaged from the first mating connector 104. In an unmated orientation (e.g., uncompressed orientation), the end surface of the grounding collar 128 of the coaxial connector 102 extends past the end surface of the first conductor first male hemispherical contact 330. The coaxial connector 102 is configured to minimize the distance that the end surface of the grounding collar 128 extends past the first conductor first male hemispherical contact 330 in an uncompressed orientation. This reduces the distance necessary for the grounding collar 128 to move (e.g., axially translate) for the first conductor 130 to contact the first mating connector 104. Accordingly, this reduces the risk of the outer spring 200 setting (and not springing back), and it reduces the spring compression and related stress on the outer spring 200. Further, in the uncompressed orientation, the first conductor second male cylindrical contact 332 is inserted into and mated with the second conductor female socket contact 360.

The grounding tube 307 is engaged with the first conductor 130 of the coaxial connector 102, thereby establishing a ground path between the first conductor 130 and the housing 124 of the coaxial connector 102. More specifically, the plurality of fingers 382 are in a closed position and engaged with the first conductor 130 forming a ground path between the first conductor 130 and all other components of the coaxial connector 102 (including the second conductor 342).

Figure 4B:
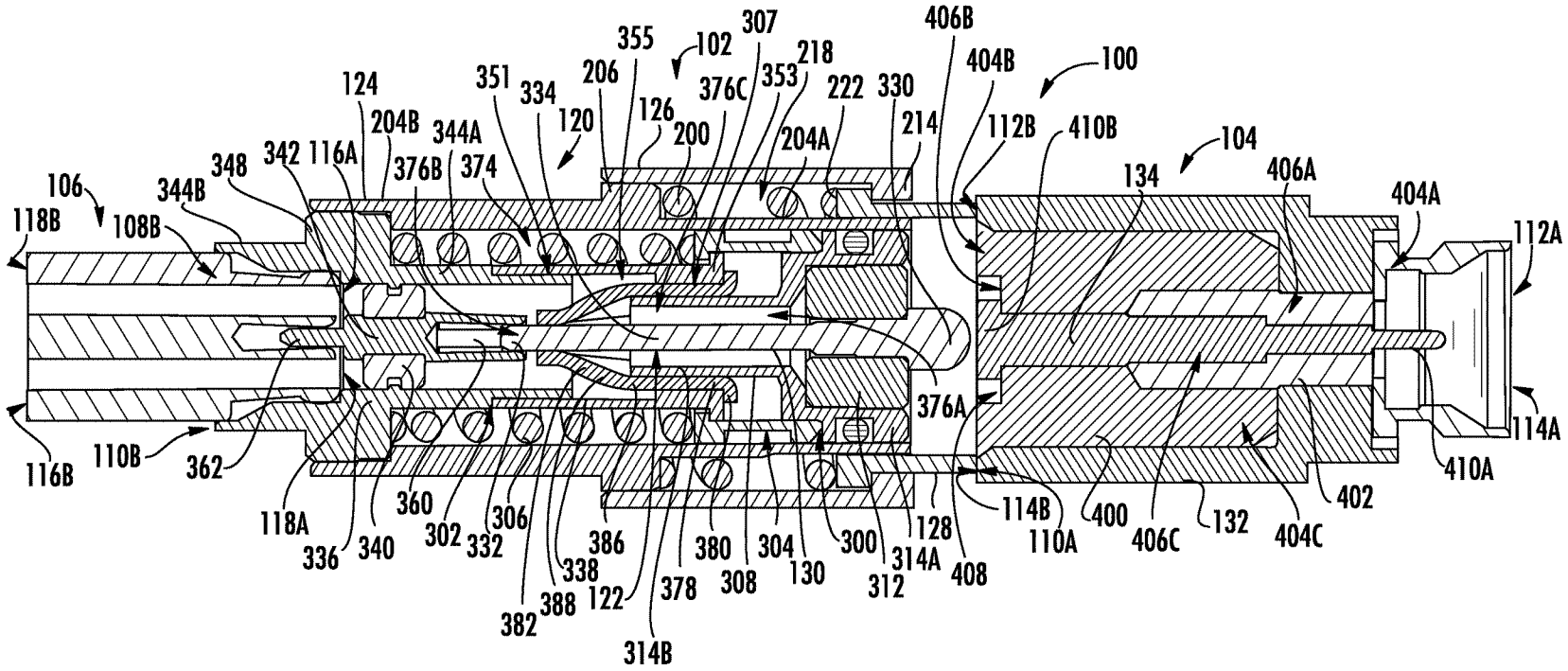
FIG. 4B is a cross-sectional side view of the coaxial connector of FIG. 4A, illustrating initial contact of the coaxial connector grounding collar with the first mating connector, and a plurality of fingers of the grounding tube in a closed position.

In FIG. 4B, the coaxial connector grounding collar 128 initially contacts the first mating connector housing 132 establishing a grounding path between the first mating connector 104 and the coaxial connector 102. When initially mated in this way, the grounding collar 128 remains in an uncompressed orientation (e.g., has not moved or axially translated), and the end surface of the grounding collar 128 of the coaxial connector 102 continues to extend past the end surface of the first conductor first male hemispherical contact 330. In other words, the first conductor 130 has not contacted the first mating connector conductor 134. Accordingly, the grounding path between the coaxial connector 102 and the first mating connector 104 is established before an electrical path. However, if an electrical charge (e.g., electrical arc) should cross the air gap from the first mating connector conductor 134 to the coaxial connector first conductor 130 before the grounding collar 128 contacts the first mating connector 104 and establishes a grounding path, the grounding tube 307 shorts the surge, thereby ensuring that the electrical surge does not extend past the first conductor 130. This protects any electronic equipment in electrical communication with the coaxial connector 102 from an electrical surge and potential damage.

Figure 4C:
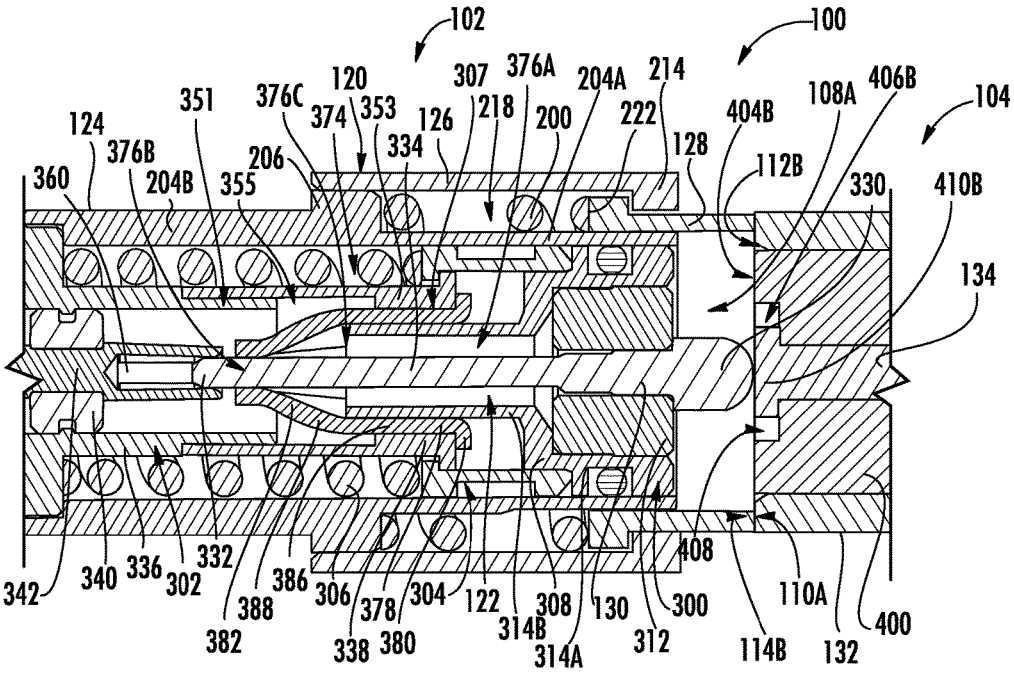
FIG. 4C is a cross-sectional side view of the coaxial connector of FIG. 4A, illustrating axial translation of the grounding collar and initial contact of the first conductor with the first mating connector, and the plurality of fingers of the grounding tube in the closed position.

In FIG. 4C, the coaxial connector grounding collar 128 maintains contact with the first mating connector housing 132 and moves (e.g., axially translates) relative to the connector housing 124. The first conductor 130 then makes initial contact with the first mating connector conductor 134 establishing an electrical path from the first mating connector 104 to the first conductor 130. However, the first conductor 130 remains in contact with the grounding tube 307, and thus, the electrical path does not extend to the second conductor 342.

Figure 4D:
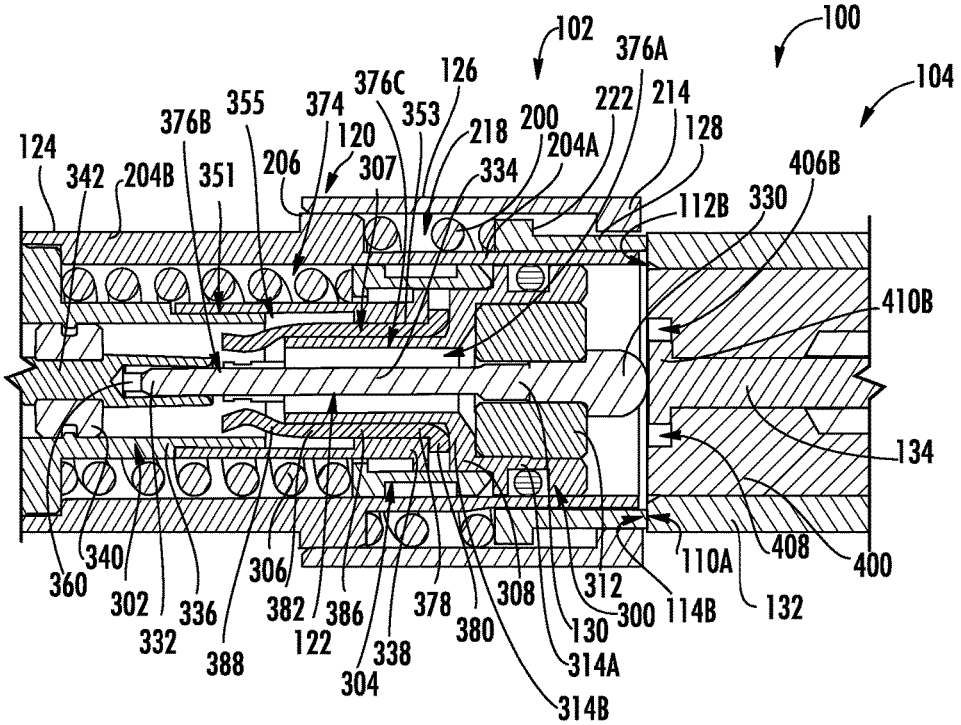
FIG. 4D is a cross-sectional side view of the coaxial connector of FIG. 4A, illustrating axial translation of the grounding collar and first conductor, and the plurality of fingers of the grounding tube in the open position.

In FIG. 4D, as the first mating connector 104 continues to move (e.g., axially translate) towards the coaxial connector 102, the grounding collar 128 and first conductor 130 move (e.g., axially translate) together. In other words, once the grounding collar 128 and the first conductor 130 are in contact with the first mating connector 104, they move (e.g., axially translate) together towards the coaxial connector second end 110B (shown in FIGS. 4A-4B). As shown, the first mating connector 104 is in a mated orientation (e.g., compressed orientation). As the first conductor 130 and the first conductor housing 308 move (e.g., axially translate) towards the coaxial connector second end 110B, the second portion 314B of the first conductor housing 308 moves relative to the grounding tube 307 and moves (e.g., outwardly pivots) the plurality of fingers 382 (the angled portion 388) of the grounding tube 307 from the closed position to the open position. This is because the outer diameter of the second portion 314B of the first conductor housing 308 is larger than the second opening 376B of the grounding tube 307 (where the second opening 376B is defined by the plurality of fingers 382 of the grounding tube 307). The plurality of outer nubs 380 of the grounding tube 307 prevent the grounding tube 307 from axially translating, such as from any frictional force imparted by the first conductor housing 308. Further, in the open position, the angled portion 388 of the plurality of fingers 382 of the grounding tube 307 pivot into the inner groove 355. This inner groove 355 provides clearance for the plurality of fingers 382 to pivot, and also keeps the inner diameter of the second conductor housing 336 and/or the inner diameter of the second conductor bushing 338 small. In certain embodiments, this may be needed to maintain certain electrical performance requirements and characteristics.

When the plurality of fingers 382 of the grounding tube 307 are moved (e.g., outwardly pivoted to) the open position, the plurality of fingers 382 disengage the first conductor 130, and the ground path between the first conductor 130 and the grounding tube 307 or the housing 124 is disconnected. Accordingly, an electrical path is established from the first mating connector conductor 134 to the coaxial connector first conductor 130, to the coaxial connector second conductor 342, and to the second mating connector 106. Further, a grounding path is established and maintained from the first mating connector housing 132, to the coaxial connector grounding collar 128, to the coaxial connector housing 124 (e.g., via the outer spring 200), to the coaxial connector second conductor housing 336, and to the second mating connector 106. More specifically, when fully mated, the grounded components of the coaxial connector 102 include the housing assembly 120 (e.g., the housing 124, the outer shell 126, the grounding collar 128, the outer spring 200), the first conductor housing 308, the intermediate bushing 304, the inner spring 306, and the second conductor housing 336.

When the first conductor 130 moves (e.g., axially translates) towards the coaxial connector second end 110B, the first conductor second male cylindrical contact 332 moves within the second conductor female socket contact 360. However, at maximum compression of the coaxial connector 102, the first conductor housing 308 contacts the plurality of outer nubs 380 of the grounding tube 307, preventing any further movement (e.g., axial translation) of the first conductor subassembly 300 towards the second conductor subassembly 302. This prevents the first conductor 130 from bottoming out against (and potentially damaging) the second conductor 342.

It is noted that although an axially translatable grounding collar 128 is shown and described above, in certain embodiments, the grounding collar 128 may be omitted or altered. For example, in certain embodiments the grounding collar 128 may not axially translate. This is made possible because the grounding tube 307 shorts any electrical current before a grounding path is made so that it is not necessary to create a grounding path before electrical communication (e.g., electrical connection, electrical coupling, etc.) of the first conductor 130 of the coaxial connector 102 with the first mating connector conductor 134.

Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is no way intended that any particular order be inferred.

It will be apparent to those skilled in the art that various modifications and variations can be made without departing from the spirit or scope of the invention. Since modifications combinations, sub-combinations and variations of the disclosed embodiments incorporating the spirit and substance of the invention may occur to persons skilled in the art, the invention should be construed to include everything within the scope of the appended claims and their equivalents.

What is claimed is:

1. A coaxial connector, comprising:

a connector housing;

a first conductor mounted within the connector housing and configured to electrically contact a first connector; and a grounding tube mounted within and in electrical communication with the connector housing, the grounding tube positioned around at least a portion of the first conductor, the grounding tube comprising a plurality of fingers inwardly radially biased and movable between a closed position and an open position, the plurality of fingers configured to electrically engage with the first conductor in the closed position to establish a grounding path between the first conductor and the connector housing;

wherein the coaxial connector is configured to establish an electrical path between the first conductor and the first connector after the plurality of fingers of the grounding tube outwardly radially pivot to the open position to electrically disengage the first conductor and disconnect the grounding path between the first conductor and the connector housing.

2. The coaxial connector of claim 1, wherein the coaxial connector is further configured to establish the electrical path between the first conductor and the first connector after establishing a grounding path between the first conductor, the grounding tube, the coaxial connector housing, and the first connector.

3. The coaxial connector of claim 1, wherein the grounding tube further comprises a tube first end positioned towards a connector housing first end of the connector housing and a tube second end positioned towards a connector housing second end of the connector housing, the tube first end fixedly positioned relative to the connector housing, the tube second end comprising the plurality of fingers.

4. The coaxial connector of claim 3, wherein the tube first end comprises a first opening, and the second tube end comprises a second opening smaller than the first opening when the plurality of fingers are in the closed position.

5. The coaxial connector of claim 4, further comprising a first conductor housing comprising a conductor housing first end and a conductor housing second end, the conductor housing second end positioned within the grounding tube and comprising a outer periphery larger than the first opening of the grounding tube and smaller than the second opening of the grounding tube when the plurality of fingers are in the closed position;

wherein at least a portion of the first conductor is positioned within the first conductor housing;

wherein movement of the first conductor housing towards the tube second end moves the plurality of fingers of the grounding tube from the closed position to the open position.

6. The coaxial connector of claim 5, wherein the coaxial connector is further configured to establish an electrical path between the first conductor and the first connector after movement of the first conductor housing relative to the grounding tube.

7. The coaxial connector of claim 1, wherein the connector housing comprises a connector housing first end and a connector housing second end, and wherein the first conductor is biased towards the connector housing first end and configured to move towards the connector housing second end upon contact with the first connector.

8. The coaxial connector of claim 7, wherein the coaxial connector is further configured to establish an electrical path between the first conductor and the first connector after movement of the first conductor towards the connector housing second end.

9. The coaxial connector of claim 7, further comprising a second conductor mounted within the connector housing, the second conductor axially aligned with the first conductor and positioned towards the housing second end relative to the first conductor.

10. The coaxial connector of claim 9, wherein the second conductor is fixedly attached to the connector housing, and wherein the second conductor is in electrical communication with the first conductor.

11. The coaxial connector of claim 1, further comprising a grounding collar mounted to and in electrical communication with the connector housing with at least a portion of the first conductor positioned within the grounding collar, the grounding collar biased towards the connector housing first end and configured to move towards the connector housing second end upon contact with a first connector;

wherein the coaxial connector is further configured to establish an electrical path between the first conductor and the first connector:

after establishing a grounding path between the grounding collar and the first connector; and after movement of the grounding collar.

12. The coaxial connector of claim 11, further comprising:

an outer shell fixedly attached to the connector housing; and a gap defined between the connector housing and the outer shell;

wherein at least a portion of the grounding collar is positioned and moveable within the gap.

13. The coaxial connector of claim 12, further comprising a first spring positioned within the gap, the first spring biasing the grounding collar towards the connector housing first end.

14. The coaxial connector of claim 13, wherein the grounding collar and the first conductor are independently biased.

15. The coaxial connector of claim 14, further comprising a second spring positioned within the connector housing, the second spring biasing the first conductor towards the connector housing first end.

16. A coaxial connector, comprising:

a connector housing comprising a connector housing first end and a connector housing second end;

a first conductor comprising a first conductor first end and a first conductor second end, the first conductor first end configured to contact a first connector, the first conductor mounted within the connector housing towards the connector housing first end by a first dielectric, the first conductor biased towards the connector housing first end and configured to move towards the connector housing second end upon contact of the first conductor first end with the first connector;

a second conductor comprising a second conductor first end and a second conductor second end, the second conductor first end in electrical contact with the first conductor second end, the second conductor second end configured to contact a second connector, the second conductor mounted within the connector housing towards the connector housing second end by a second dielectric, the second conductor fixed relative to the connector housing;

a grounding tube mounted within and in electrical communication with the connector housing, the grounding tube positioned around at least a portion of the first conductor, the grounding tube comprising a plurality of fingers inwardly radially biased and movable between a closed position and an open position, the plurality of fingers configured to electrically engage with the first conductor in the closed position to establish a grounding path between the first conductor and the connector housing; and a grounding collar mounted to and in electrical communication with the connector housing with at least a portion of the first conductor positioned within the grounding collar, the grounding collar biased towards the connector housing first end and configured to move towards the connector housing second end upon contact with the first connector;

wherein the coaxial connector is configured to establish an electrical path between the second conductor, the first conductor, and the first connector;

after establishing a grounding path between the first conductor, the grounding tube, the connector housing, the grounding collar, and the first connector;

after movement of the grounding collar relative to the connector housing;

after movement of the first conductor relative to the connector housing and the grounding tube; and after the plurality of fingers of the grounding tube outwardly radially pivot to the open position to electrically disengage the first conductor and disconnect the grounding path between the first conductor and the connector housing.

17. The coaxial connector of claim 16, wherein the grounding tube further comprises a tube first end positioned towards the connector housing first end and a tube second end positioned towards the connector housing second end, the tube first end fixedly positioned relative to the connector housing, and the tube second end comprising the plurality of fingers.

18. The coaxial connector of claim 17, wherein the tube first end comprises a first opening, and the second tube end comprises a second opening smaller than the first opening when the plurality of fingers are in the closed position.

19. The coaxial connector of claim 18, further comprising a first conductor housing comprising a conductor housing first end and a conductor housing second end, the conductor housing second end positioned within the grounding tube and comprising an outer periphery larger than the first opening of the grounding tube and smaller than the second opening of the grounding tube when the plurality of fingers are in the closed position;

wherein at least a portion of the first conductor is positioned within the first conductor housing; and wherein movement of the first conductor housing towards the tube second end moves the plurality of fingers of the grounding tube from the closed position to the open position.

20. The coaxial connector of claim 19, wherein the coaxial connector is further configured to establish an electrical path between the first conductor and the first connector after movement of the first conductor housing relative to the grounding tube.

21. The coaxial connector of claim 16, wherein the grounding collar and the first conductor are independently biased.

* * * * *